US009086041B2

(12) United States Patent
Jalal et al.

(10) Patent No.: US 9,086,041 B2
(45) Date of Patent: Jul. 21, 2015

(54) FUEL INJECTOR HAVING A PIEZOELECTRIC ACTUATOR AND A SENSOR ASSEMBLY

(75) Inventors: Syed S. Jalal, Greenwood, IN (US); Douglas W. Memering, Columbus, IN (US); Richard E. Reisinger, Columbus, IN (US); Edward B. Manring, Columbus, IN (US); Jesus Carmona-Valdes, Columbus, IN (US); Anthony A. Shaull, Columbus, IN (US); Shankar C. Venkataraman, Columbus, IN (US); William D. Daniel, Scipio, IN (US); Viktor K. Walter, Nyköping (SE); Lawrence C. Melton, Seymour, IN (US)

(73) Assignee: CUMMINS INTELLECTUAL PROPERTY, INC., Minneapolis, MN (US)

( * ) Notice: Subject to any disclaimer, the term of this patent is extended or adjusted under 35 U.S.C. 154(b) by 683 days.

(21) Appl. No.: 13/354,165

(22) Filed: Jan. 19, 2012

(65) Prior Publication Data

US 2013/0026257 A1 Jan. 31, 2013

Related U.S. Application Data

(60) Provisional application No. 61/434,013, filed on Jan. 19, 2011.

(51) Int. Cl.
*F02M 51/06* (2006.01)
*F02M 57/00* (2006.01)

(52) U.S. Cl.
CPC ..... *F02M 51/0603* (2013.01); *F02M 57/005* (2013.01); *F02M 2200/244* (2013.01)

(58) Field of Classification Search
CPC ..... F02M 51/0603; F02M 57/005; F02M 2200/244; F02D 2041/2055; F02D 41/2096
USPC ..... 239/73, 585.1, 585.5, 102.1, 102.2, 239/533.2, 584
See application file for complete search history.

(56) References Cited

U.S. PATENT DOCUMENTS

| | | | |
|---|---|---|---|
| 6,253,736 | B1 | 7/2001 | Crofts et al. |
| 6,318,342 | B1 | 11/2001 | Simon et al. |
| 6,650,032 | B2 | 11/2003 | Sumrak et al. |
| 6,837,221 | B2 | 1/2005 | Crofts et al. |

(Continued)

FOREIGN PATENT DOCUMENTS

| | | |
|---|---|---|
| DE | 3103061 A1 | 8/1982 |
| EP | 1169568 B1 | 7/2007 |

(Continued)

OTHER PUBLICATIONS

The International Search Report and the Written Opinion from the International Searching Authority dated May 8, 2012; International Application No. PCT/US2012/021900.

*Primary Examiner* — Jason Boeckmann
(74) *Attorney, Agent, or Firm* — Faegre Baker Daniels LLP

(57) ABSTRACT

A fuel injector includes a piezoelectric actuation mechanism and a sensor configuration to measure the condition of the actuation mechanism as well as an associated fuel rail. The sensor configuration includes a piezoelectric sensor with an output signal with significantly reduced distortion that accurately reflects control signals provided to the piezoelectric actuation mechanism.

17 Claims, 5 Drawing Sheets

(56) References Cited

U.S. PATENT DOCUMENTS

| | | | |
|---|---|---|---|
| 7,077,379 | B1 | 7/2006 | Taylor |
| 7,456,545 | B2 | 11/2008 | Huber et al. |
| 7,528,524 | B2 | 5/2009 | Rueger et al. |
| 2006/0255695 | A1 | 11/2006 | Endriss |
| 2009/0063010 | A1 | 3/2009 | Nakata et al. |
| 2009/0063013 | A1 | 3/2009 | Nakata et al. |
| 2009/0063016 | A1 | 3/2009 | Nakata et al. |
| 2010/0288239 | A1 | 11/2010 | Morris et al. |
| 2010/0313853 | A1 | 12/2010 | Morris et al. |

FOREIGN PATENT DOCUMENTS

| | | | |
|---|---|---|---|
| JP | 10-288119 | A | 10/1998 |
| WO | 2012100075 | A1 | 7/2012 |

FUEL INJECTOR HAVING A PIEZOELECTRIC ACTUATOR AND A SENSOR ASSEMBLY

CROSS-REFERENCE TO RELATED APPLICATIONS

This application claims the benefit of priority to U.S. Provisional Patent Application No. 61/434,013, filed on Jan. 19, 2011, which is hereby incorporated by reference in its entirety.

TECHNICAL FIELD

This disclosure relates to fuel injectors using a piezoelectric actuation mechanism and a sensor configuration to measure the condition of the actuation mechanism as well as an associated fuel rail.

BACKGROUND

Actuation of fuel injectors is a critical feature of internal combustion engines. For fuel injector systems using piezoelectric actuators, also called piezoactuators, it is beneficial to predict injection fueling characteristics, including the timing of start and end of injection, fueling quantity, etc., during operation. However, present systems for measuring and predicting fueling characteristics have insufficient sensitivity and accuracy to provide reliable and consistent closed loop control of piezoelectric fuel injectors. A reliable system for measuring and predicting fueling characteristics would be insensitive to the operating environment, which includes the forces within a fuel injector, and could have the potential to diagnose the health of the fuel injector elements.

SUMMARY

This disclosure provides a fuel injector assembly for an internal combustion engine. The fuel injector assembly comprises a piezoelectric actuation portion, a nozzle portion, a plunger, a piezoelectric sensor, and a rigid body. The piezoelectric actuation portion includes a piezoelectric stack having a distal end. A plunger is positioned axially between the nozzle portion and the piezoelectric stack and the plunger is adapted for movement by the piezoelectric stack. The piezoelectric sensor is positioned between the piezoelectric actuation portion and the plunger. The piezoelectric sensor is adapted to generate an output signal. A rigid body is positioned axially between the distal end of the piezoelectric stack and the piezoelectric sensor to position the piezoelectric sensor a spaced distance from the distal end of the piezoelectric stack. The rigid body includes a first surface positioned to support the piezoelectric sensor and a second surface positioned to receive a force from the piezoelectric stack.

This disclosure also provides a fuel injector assembly for an internal combustion engine comprising a piezoelectric actuation portion, a nozzle portion, a plunger, and an interface portion. The piezoelectric actuation portion has an abutting surface. The plunger is positioned axially between the nozzle portion and the piezoelectric actuation portion and is adapted for movement by the piezoelectric portion. The interface portion is positioned between the piezoelectric actuation portion and the plunger and in contact with the piezoelectric actuation portion and the plunger. The interface portion includes a piezoelectric sensor and a rigid body to support the piezoelectric sensor. The rigid body is adapted to contact the abutting surface and adapted to space the piezoelectric sensor away from the piezoelectric actuation portion.

This disclosure also provides a fuel injector assembly for an internal combustion engine comprising a piezoelectric actuation portion, a nozzle portion, a plunger, and an interface portion. The piezoelectric actuation portion has an abutting surface. The plunger is positioned axially between the nozzle portion and the piezoelectric actuation portion and adapted for movement by the piezoelectric actuation portion. The nozzle portion is operable by movement of the piezoelectric actuation portion to have a start of injection event and an end of injection event. The interface portion is positioned between the piezoelectric actuation portion and the injection portion and is in contact with the piezoelectric actuation portion and the injection portion. The interface portion includes a piezoelectric sensor adapted to provide a decreasing signal during the start of injection event and an increasing signal during the end of injection event.

Advantages and features of the embodiments of this disclosure will become more apparent from the following detailed description of exemplary embodiments when viewed in conjunction with the accompanying drawings.

DETAILED DESCRIPTION

Figure 1:
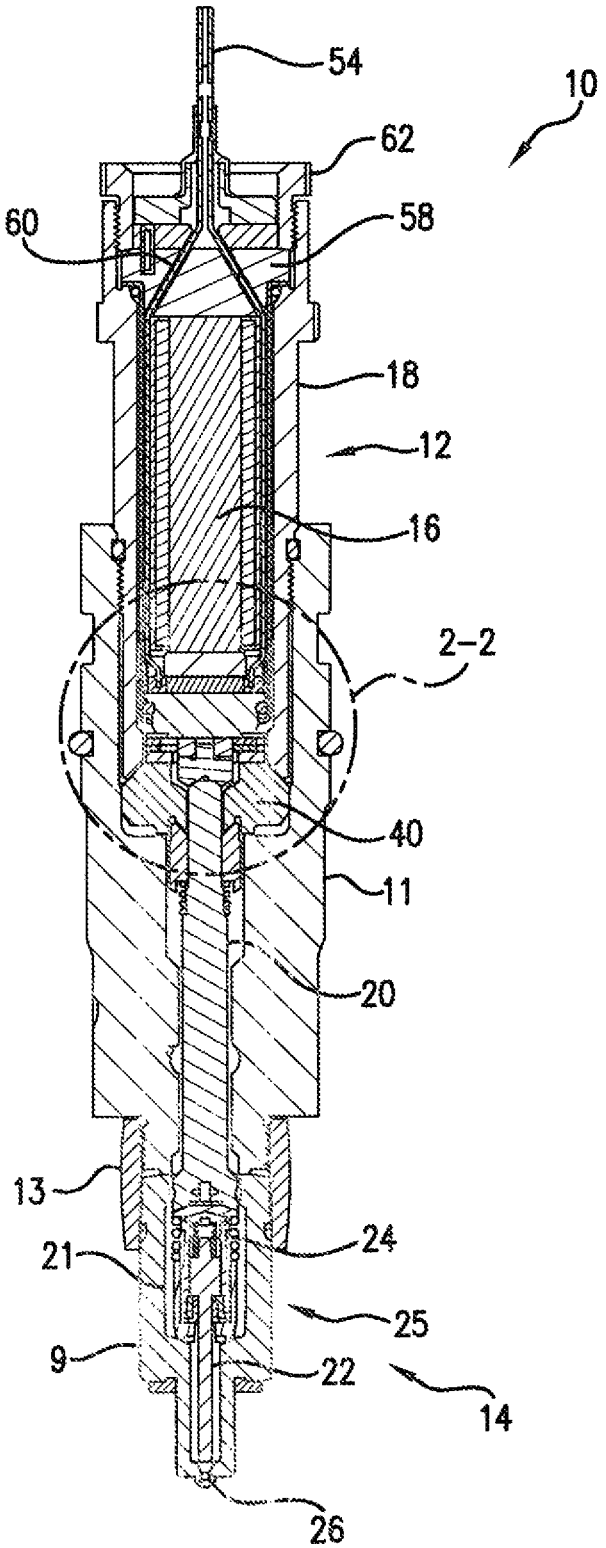
FIG. 1 is a section view of a fuel injector assembly in accordance with an exemplary embodiment of the present disclosure.

Shown in FIG. 1 is a cross section of an elongated fuel injector assembly 10 incorporating an exemplary embodiment of the present disclosure. Fuel injector 10 includes an actuation portion 12 including a piezoelectric actuator stack 16, a nozzle portion 14 including a nozzle housing 9, and a barrel 11 that spans or extends from actuation portion 12 to nozzle portion 14. A retainer 13 contains internal threads for engaging corresponding external threads on the lower end of barrel 11 and the upper end of nozzle housing 9 to permit barrel 11 and nozzle housing 9 to be held together in compressive abutting relationship by simple relative rotation of retainer 13 with respect to barrel 11 and nozzle housing 9.

Because fuel injectors may have various orientations, the terms up and down are relative rather than absolute. For consistency of description, actuation portion 12 extends from the proximate, top, upper, outer, or near end of fuel injector 10 and nozzle portion 14 extends from the distal, bottom, lower, inner, or far end of fuel injector 10. Also for consistency of description, the terms axially and longitudinally are generally synonymous, and refer to the direction along the central axis of fuel injector 10 that extends from the proximate end to the distal end of fuel injector 10.

Nozzle portion 14 includes a nozzle cavity 21 formed in housing 9, a nozzle or needle valve element 22, a bias spring 24, and one or more injector orifices or passages 26 formed in housing 9. Nozzle portion 14 forms a closed nozzle assembly in that nozzle valve element 22 is biased by spring 24 into a closed position blocking flow through injector orifices 26. Nozzle valve element 22 is reciprocally mounted for movement between the closed position and an open position permitting flow through injector orifices 26. In the exemplary embodiment, nozzle portion 14 includes a hydraulic link assembly 25, which functions to convert the downward motion of piezoelectric stack 16 to an upward motion of needle valve element 22, as well as to amplify the motion of piezoelectric stack 16 to lift needle valve element 22 by an appropriate amount. Injector 10 is direct acting in that it directly uses the force of actuator portion 12 to apply a moving force to needle valve element 22 and does not require an intermediate pressure or force loss, such as depressurizing a pressurized control volume by creating a low-pressure drain flow from a control volume. The structure and function of the nozzle portion is discussed in detail in U.S. patent application Ser. No. 12/797,161 filed Jun. 9, 2010, the entire contents of which is hereby incorporated by reference. U.S. patent application Ser. No. 12/466,026 filed May 14, 2009 entitled "Piezoelectric Direct Acting Fuel Injector with Hydraulic Link," the entire contents of which is hereby incorporated by reference, also describes features that may be incorporated into the injector of the present disclosure. In other exemplary embodiments, other nozzle portions that are capable of controlling flow through injector orifices may also be used.

Injector 10 also includes a plunger 20. Actuation portion 12 is specifically designed to enable precise control over the movement of nozzle valve element 22 from its closed to its open position so as to predictably control the flow of fuel through injector orifices 26 for achieving a desired fuel metering and, preferably, injection rate change. As shown in FIG. 1, actuation portion 12 includes plunger 20 and piezoelectric actuator or stack 16 for selectively moving plunger 20, e.g. through a predetermined variable lift schedule, upon actuation to precisely control the movement of nozzle valve element 22. Piezoelectric actuator 16 includes a columnar laminated body, or stack, of thin disk-shaped elements each having a piezoelectric effect and an actuator housing 18. When a voltage, i.e., +150 volts, is applied to each element, the element expands along the axial or longitudinal direction of the column. Conversely, when a voltage of −150 volts is applied to each element, the element contracts so that the inner end of piezoelectric actuator 16 moves away from nozzle portion 14. The lower or distal end of piezoelectric actuator or stack 16 abuts the upper end of an interface portion 30, best seen in FIG. 2, so that the expansion/contraction of piezoelectric actuator 16 is directly transmitted through interface portion 30 to plunger 20.

Actuator housing 18 mates with barrel 11, which prevents relative movement of housing 18 with respect to barrel 11 and captures an interface spacer 40, which is described in more detail hereinbelow. A plug 62 mates with a proximate end of housing 18 and permits adjustment of the amount of compression on a cap 58, piezoelectric actuator or stack 16, and the interface portion 30, compressing one or more spring washers 43 against a seat 45, thus generating a preload on piezoelectric actuator or stack 16. Piezoelectric actuator 16 may include any type or design of piezoelectric actuator capable of actuating plunger 20 and hydraulic link assembly 25 as described hereinbelow.

It should be noted that the actuation and de-actuation of actuator or stack 16 is controlled by a control device (not shown), i.e., an electronic control unit, which precisely controls the timing of injection by providing an injection control signal to actuator 16 at a predetermined time during engine operation, the fuel metering by controlling the duration of the injection control signal and, preferably, also the injection rate shape by controllably varying the voltage supply to actuator 16 based on engine operating conditions.

Figure 2:
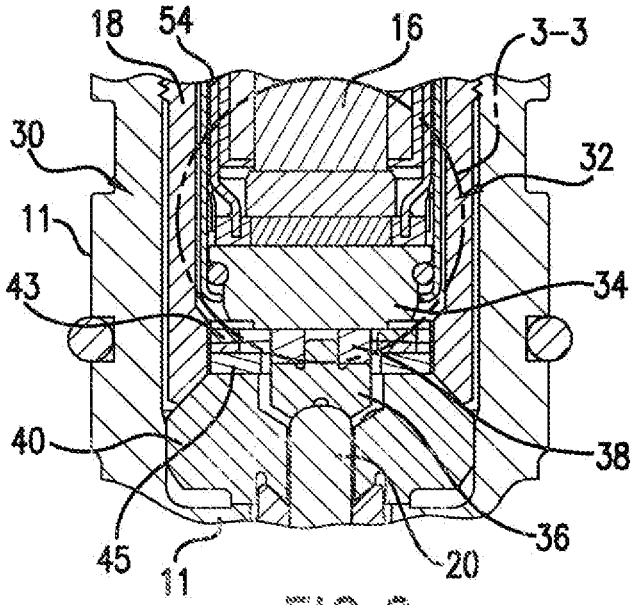
FIG. 2 is a portion of the fuel injector assembly of FIG. 1 in the area of line 2-2.

Referring now to FIG. 2, positioned between actuation portion 12 and nozzle portion 14 is interface portion 30. Interface portion 30 transmits force between plunger 20 and piezoelectric stack 16. Interface portion 30 includes a sensor 52 and a rigid body 50 positioned between sensor 52 and the distal end of stack 16. In the exemplary embodiment, interface portion 30 also includes a sensor platform 34 positioned on the opposite side of sensor 52 from actuation portion 12 and abutting sensor 52, a support 38 and a guide 36. In the exemplary embodiment, rigid body 50 abuts, i.e. directly contacts, piezoelectric stack 16, while sensor platform 34 abuts, i.e. directly contacts sensor 52. In the exemplary embodiment, rigid body 50 forms a carrier or housing for sensor 52 thereby forming a sensor assembly 32 as described more fully hereinbelow. In the exemplary embodiment, support 38 and guide 36 are positioned axially between sensor platform 34 and plunger 20 to transmit force/motion between piezoelectric stack 16 and plunger 20. Interface spacer 40, positioned longitudinally between barrel 11 and an actuator housing 18, includes a bore through which an outer end of plunger 20 extends to contact guide 36. One or more springs or spring washers 43 and seat 45 may be in a location axially between interface spacer 40 and sensor platform 34. As previously noted, spring washers 43 may provide a preload for piezoelectric actuator 16.

Figure 3:
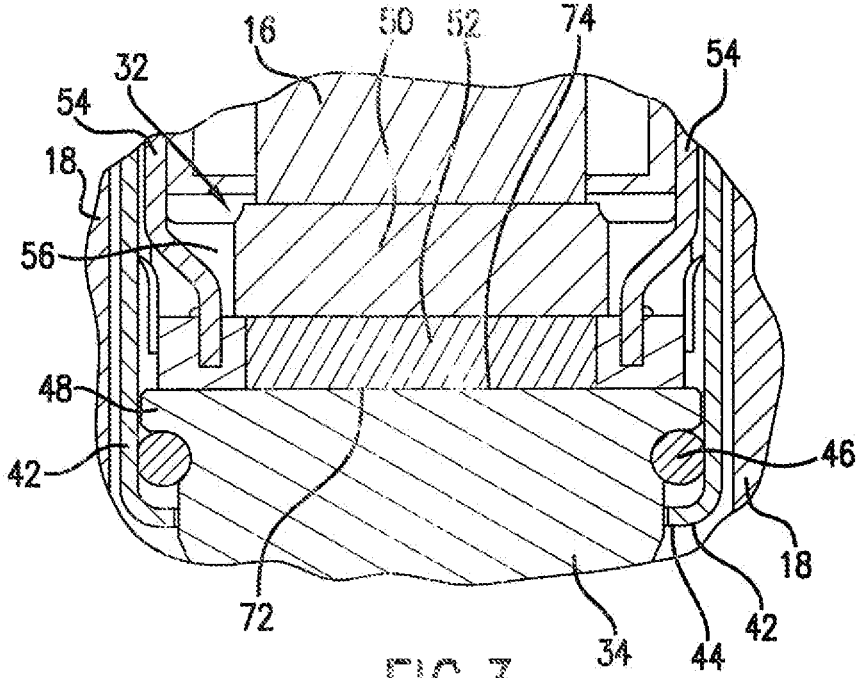
FIG. 3 is a portion of the fuel injector assembly of FIG. 2 in the area of line 3-3.
Figure 4:
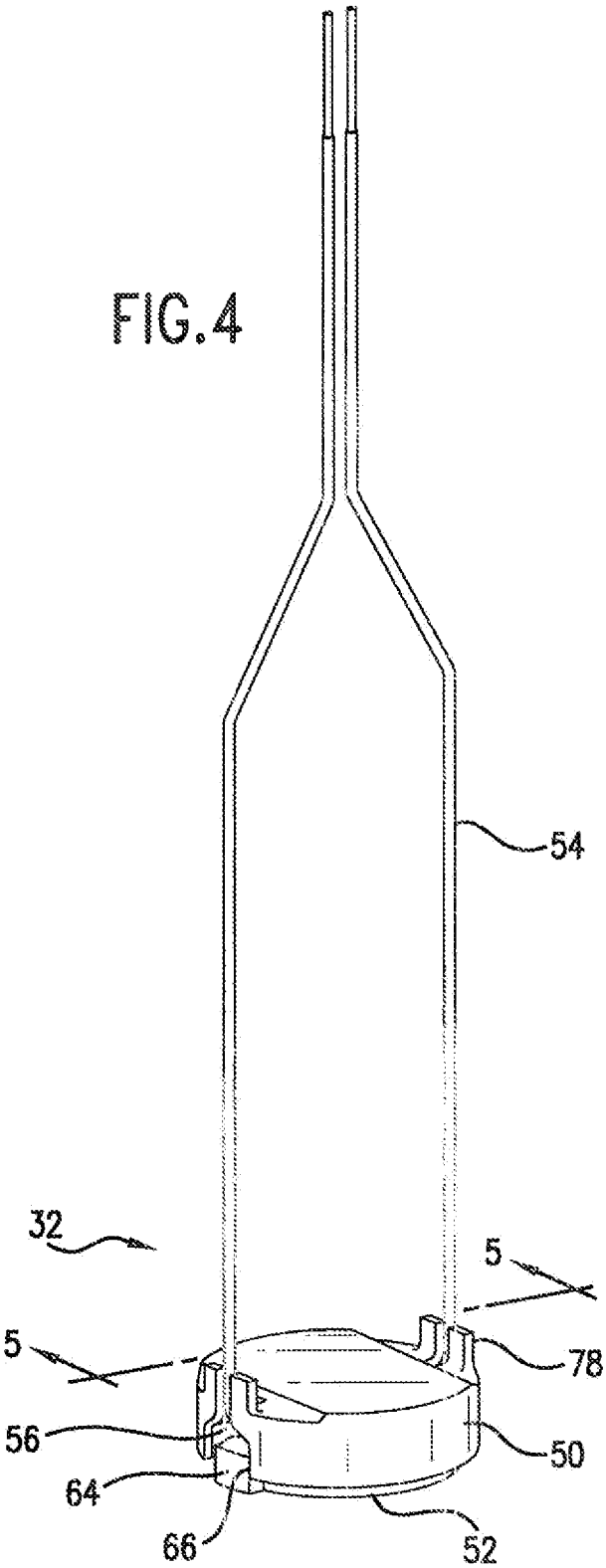
FIG. 4 is a perspective view of a sensor assembly in accordance with an exemplary embodiment of the present disclosure.
Figure 5:
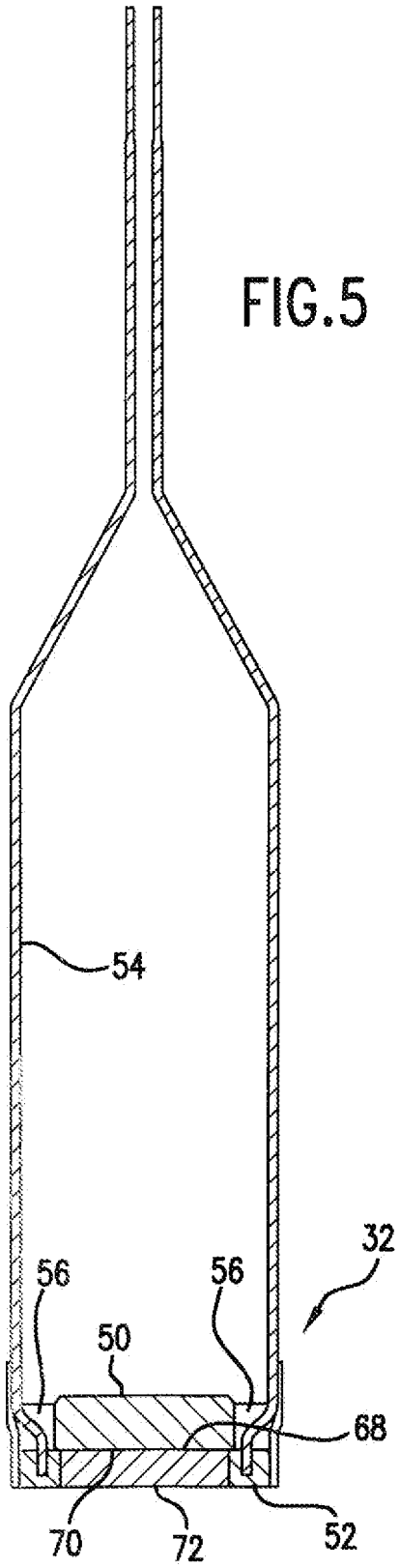
FIG. 5 is a section view of the sensor assembly of FIG. 4 along the line 5-5.
Figure 6:
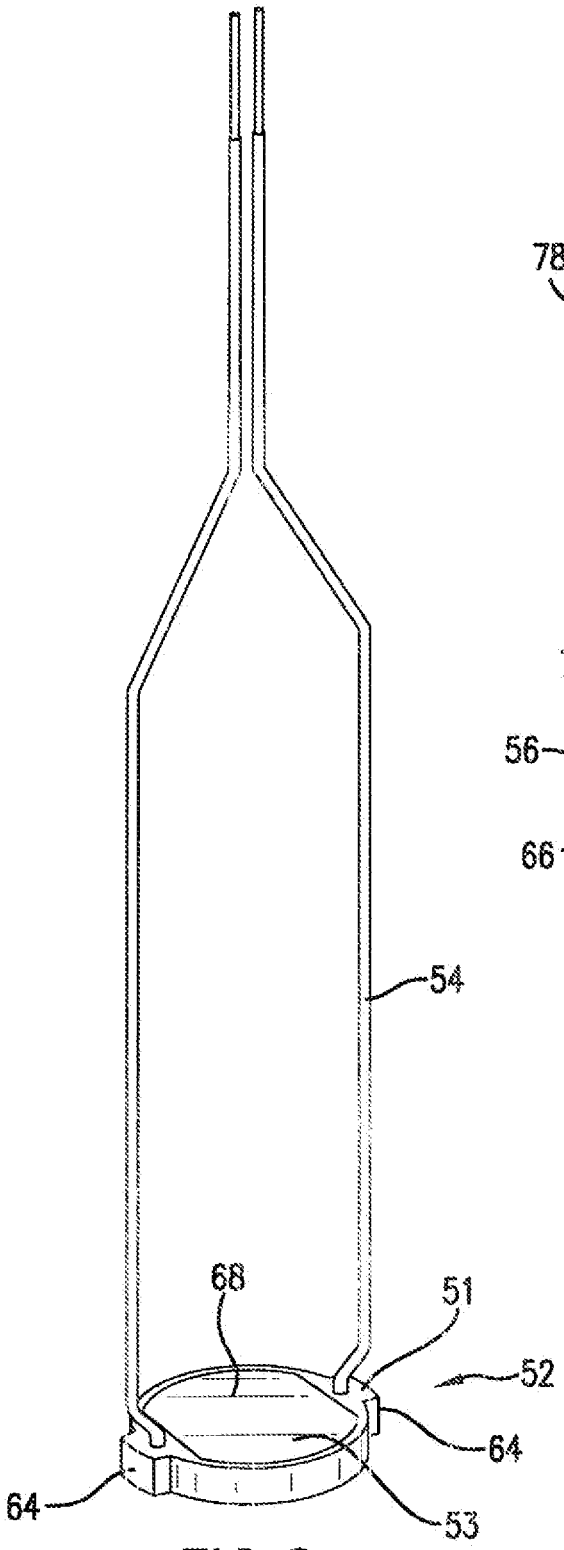
FIG. 6 is a perspective view of a piezoelectric sensor of the sensor assembly of FIG. 4.
Figure 7:
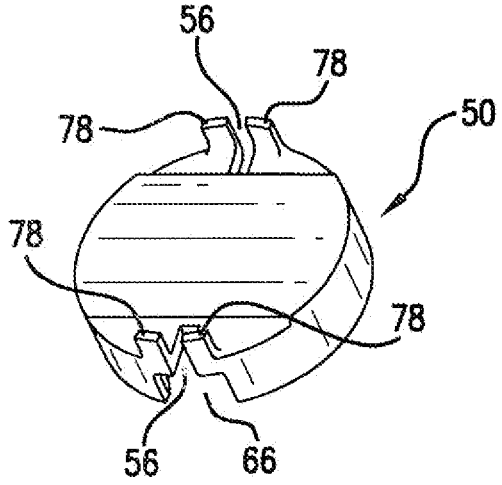
FIG. 7 is a first perspective view of a carrier of the sensor assembly of FIG. 4.
Figure 8:
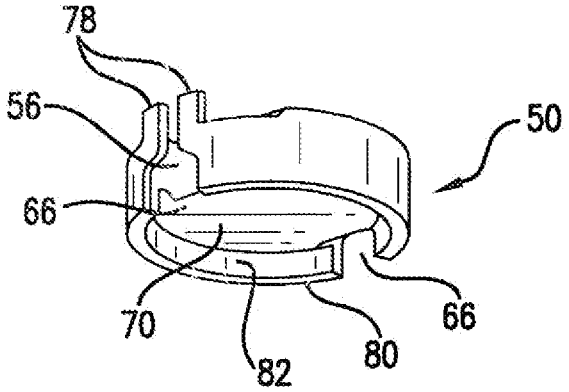
FIG. 8 is a second perspective view of the carrier of the sensor assembly of FIG. 4.

Sensor assembly 32 is positioned axially or longitudinally along the fuel injector axis between piezoelectric stack 16 of actuation portion 12 and plunger 20. In the exemplary embodiment, sensor platform 34, support 38 and guide 36 are positioned between plunger 20 and sensor assembly 32 to provide a direct link for transmitting force and motion from piezoelectric stack 16 to plunger 20. Referring to FIG. 3, piezoelectric stack 16, sensor assembly 32, and sensor platform 34 are slidably or movably captured within a retainer 42. Retainer 42 may include a lip 44 or other feature to prevent sensor platform 34 and the other elements restrained within retainer 42, such as piezoelectric stack 16, from disengaging from retainer 42 during assembly. Adjacent to a head 48 of sensor platform 34 is a seal 46. Carrier 50 and sensor 52 are positioned axially between piezoelectric stack 16 and may be in contact with sensor platform 34. While the exemplary embodiment describes a specific configuration of elements, including carrier 50, sensor platform 34, support 38, guide 36, etc., other embodiments may include more or fewer elements that serve the purpose of transmitting force from piezoelectric actuator 16 to plunger 20 so long as a rigid body 50 is positioned or extends between the sensor and the distal end of the stack of piezoelectric elements. For example, in other embodiments, carrier 50 may contain multiple elements and/or plunger 20 may interface directly with sensor platform 34.

Referring now to FIGS. 4-8, sensor assembly 32 and features of sensor assembly 32 are shown. As previously noted, sensor assembly 32 includes housing or carrier 50 and piezoelectric sensor 52. While sensor 52 is described herein as a piezoelectric sensor, sensor 52 may be any pressure or force sensor or transducer having sufficient force sensitivity and having a size that permits placing the sensor as shown in the figures. In the exemplary embodiment, sensor 52 includes a pressure sensitive portion 53, an annular portion 51 positioned about pressure sensitive portion 53, and a pair of insulated leads or wires 54 that extend from annular portion 51. Wires 54 may be guided by a pair of channels 56 formed in a periphery of carrier 50. The position of channels 56 and the diameter of carrier 50 permits routing wires 54 past piezoelectric stack 16, as shown in FIG. 1, while keeping the bend radius of wires 54 within design limits. Keeping the bend radius within design limits also keeps the bend stress of wires 54 within design limits as wires 54 are routed from the point where they exit sensor 52 to the diameter of piezoelectric stack 16, particular as shown in FIG. 3. Wires 54 are routed along an interior surface of retainer 42 to a proximate or first end of fuel injector 10, where the wires are routed through cap 58 that contains one or more passages 60, shown in FIG. 1. Passages 60 permit wires 54 to route from a periphery of piezoelectric stack 16 toward a longitudinal axis of fuel injector 10 while keeping the bend radius and thus the bend stress of wires 54 within design limits for wires 54. From cap 58, wires 54 pass through a central portion of plug 62.

Annular portion 51 of sensor 52 may include one or more sensor protrusions 64 that engage openings 66 in carrier 50 to prevent rotation of sensor 52 within carrier 50, which would be deleterious to wires 54. A first surface or portion 68 of sensor 52 is positioned within carrier 50 is in abutting contact with an inner surface 70 of carrier 50. First surface 68 and inner surface 70 may be a flat surface, planar surface, or other types of mating surfaces. A second surface or portion 72 of sensor 52, which may be seen in FIGS. 3 and 5, abuts contact surface 74 of sensor platform 34. Second surface 72 and contact surface 74 may be a flat surface, planar surface, or other types of mating surfaces. Carrier 50 may include one or more carrier protrusions 78 that mate with features formed within actuation portion 12 to prevent rotation of sensor assembly 32 with respect to actuation portion 12, which could be deleterious to wires 54. Channels 56 may extend through or between protrusions 78 to permit wires 54 to pass between a pair of protrusions 78. A sidewall 82 extends longitudinally from surface 68 to form a recess for receiving sensor 52. The interior or lower edge of sidewall 82 may include a lip 80 that extends radially inwardly in a direction toward a longitudinal axis of carrier 50 from sidewall 82 of carrier 50. Sidewall 82 may have a diameter that is greater than the diameter of sensor 52 to permit ease of assembly. However, lip 80 extends to a diameter that provides an interference fit with sensor 52 to retain sensor 52 within carrier 50 during assembly. The amount of the interference fit depends on the material of carrier 50. Carrier 50 should be a rigid material, preferably a metal material. In an exemplary embodiment, the metal used may be a stainless steel.

When actuation portion 12 is commanded by a control module, ECM, ECU or equivalent mechanism (not shown), actuation portion 12 receives a voltage signal. Piezoelectric stack 16 responds to the voltage signal by expanding along the longitudinal axis of fuel injector 10, which moves sensor assembly 32 longitudinally along fuel injector 10 toward the distal end of fuel injector 10. The movement of sensor assembly 32 causes the other elements of interface portion 30 to move longitudinally. Specifically, sensor platform 34, support 38, and guide 36 move longitudinally toward the distal end of fuel injector 10. The movement of sensor platform 34 is possible because the outside diameter of sensor platform 34 is less than the inside diameter of retainer 42. Seal 46 maintains a seal between the interior of retainer 42 and the exterior of sensor platform 34, preventing fuel from entering retainer 42. The movement of support 38 and guide 36 causes plunger 20 to move longitudinally toward the distal end of fuel injector 10.

The movement of plunger 20 causes hydraulic link 25 to lift needle valve element 22 in a conventional manner. As needle 22 begins to move away from an interior seat formed in nozzle housing 9, high pressure fuel in nozzle cavity 21 from a fuel rail (not shown) in fluid communication with nozzle cavity 21 may aid to rapidly move needle 22 away from the seat formed internally to nozzle housing 9 in a conventional manner.

The inventors recognize that it is beneficial to predict injection fueling characteristics, including start and end (timing) of injection, fueling quantity, etc., during operation. Based on these real-time estimations, closed-loop controls can be implemented to account for hardware and operating condition variability. The health of the piezoelectric stack and the mechanical injector may also be diagnosed. Feedback from a piezoelectric actuation mechanism may provide some improvement in the control of piezoelectric actuators. For example, commonly owned U.S. Pat. Nos. 6,253,736 and 6,837,221 describe different techniques for achieving feedback from the piezoelectric elements of fuel injectors. While these techniques offer improvements in measuring the function of piezoelectric actuation devices, additional sensitivity and reduced noise from the piezoelectric sensor could yield improved control over the function of a fuel injector.

A piezoelectric actuator/injector may incorporate a force feedback sensor to react to forces resulting from actuation of the piezoelectric actuator, and to forces resulting from injector hydraulic dynamics, i.e., in the injector nozzle assembly. Depending on the assembly, placement and positioning of the feedback force sensor inside the actuator/injector, the output voltage amplitude of the piezoelectric force sensor varies significantly. The piezoelectric force sensor output, i.e., the force signature, becomes distorted, which leads to unacceptable, i.e., minimal or no, correlation to the physical events of the fueling characteristics.

Test results have shown significant bias voltage and distortion from a piezoelectric force sensor when the sensor is in an encapsulated epoxy housing inside the piezoelectric actuator. The theory behind the distorted and biased negative voltage is that the sensor responds to the lateral piezoelectric motion (Poisson's effect) and/or by the convex surface of the end of the piezoelectric actuator during motion of the piezoelectric stack.

Improved sensor assembly 32 ensures the feedback signal received from sensor assembly 32 represents the actual force inside the injector. More specifically, the inventors discovered that separating piezoelectric sensor 52 from piezoelectric stack 16 by using, for example, housing or carrier 50 formed of a rigid material, such as metal, in which the piezoelectric sensor is positioned, such as being snapped into place, yields an unexpected improvement in the signal from piezoelectric sensor 52. When piezoelectric sensor 52 is freed out from or spaced from the encapsulated plastic housing of piezoelectric actuator stack 16, and separated from piezoelectric stack 16 by a rigid carrier, the output signal accurately represents the dynamics inside piezoelectric actuator 16 as shown in FIG. 9.

Piezoelectric sensor 52 is located between piezoelectric stack 16 and nozzle portion 14, which is the force transmitting structure to transmit the actuating force to needle 22 positioned in nozzle housing 9. Since piezoelectric sensor 52 reacts to a transient force, piezoelectric sensor 52 reacts to both piezoelectric actuation and to the injector hydraulic dynamics. Thus, piezoelectric sensor 52 acts as a force and pressure sensor inside fuel injector 10. Upon analyzing the signature of piezoelectric sensor 52 voltage output, the fueling characteristics of an injection event can be captured with unexpected precision, as shown in FIG. 9. The health of fuel injector 10 and potentially the health of an associated fuel rail (not shown) can also be diagnosed.

Figure 9:
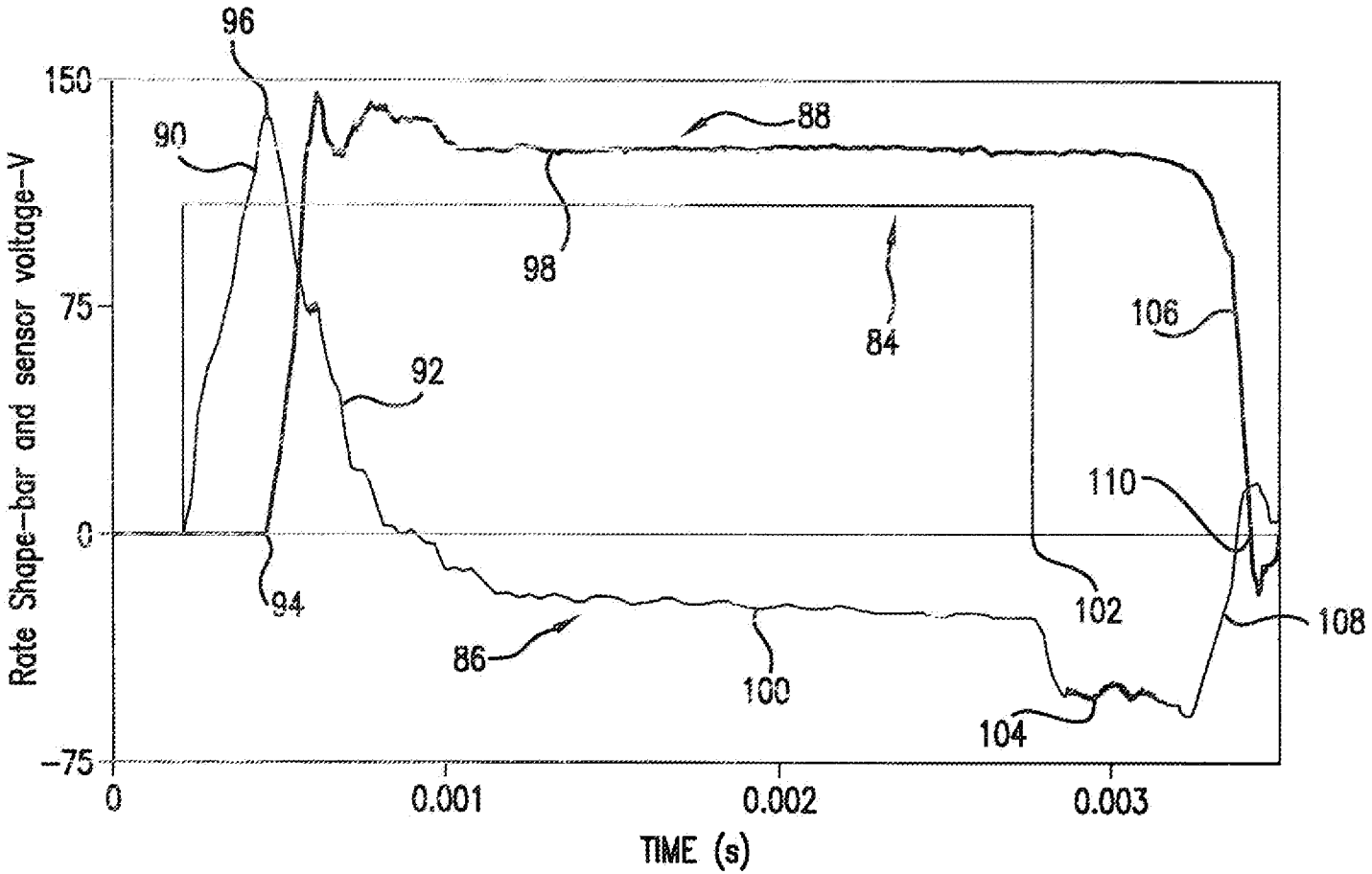
FIG. 9 is a graph showing plots of fuel injector actuation, piezoelectric sensor output, and fueling rate with time.

Referring to FIG. 9, the graph contains three curves. Actuation signal curve 84 corresponds to an actuation voltage or signal directed to actuation portion 12. More specifically, actuation signal curve 84 corresponds to a voltage signal or signal applied to piezoelectric stack 16. Sensor signal curve 86 corresponds to a signal from piezoelectric sensor 52, which is indicative of pressure from actuation portion 12 and may be indicative of pressure from nozzle portion 14, as will be explained in more detail hereinbelow. Fueling rate curve 88 corresponds to the actual rate of fueling from fuel injector 10.

When actuation portion 12 receives a voltage signal indicative of a fueling event, represented by actuation signal curve 84 in FIG. 9, piezoelectric stack 16 expands longitudinally and pushes sensor assembly 32, i.e. carrier 50 and piezoelectric sensor 52, which applies a longitudinal force to force transmitting components of fuel injector 10, which have been described hereinabove. Initially, the pressure exerted by piezoelectric actuator 16 increases because of the requirement to move components in hydraulic link 25. Piezoelectric sensor 52 provides positive voltage due to compression at curve portion 90 in FIG. 9. Needle valve element 22 begins to lift or open, represented by point 94 on fueling rate curve 88, which corresponds to point 96 on sensor signal curve 86, representing a start of injection (SOI) event. Pressure from the fuel rail (not shown) assists in the lifting process and the voltage signal from piezoelectric sensor 52 decreases along curve portion 92 toward and then below zero volts.

As needle 22 continues to open, fuel flow through nozzle or injector orifices 26 increases and the pressure from the fuel rail may relieve some of the preload exerted by springs 43 on piezoelectric actuator 16. The signal from piezoelectric sensor 52 captures or reflects this change in pressure by a decreasing voltage. Once the fueling rate settles to a fully developed flow or steady state, at portion 98 of fueling rate curve 88, the pressure exerted on plunger 20 by the fuel rail is at a maximum and the voltage output of piezoelectric sensor 52 levels out in the region of portion 100 of sensor signal curve 86. Once piezoelectric stack 16 is deactivated, i.e., the voltage signal to actuator portion 12 ceases or a negative voltage is applied to piezoelectric stack 16, shown at point 102 on actuation signal curve 84, piezoelectric stack 16 begins to contract. As piezoelectric stack 16 contracts, bias springs in hydraulic link 25 force plunger 20 toward the proximate or upper end of fuel injector 10, which also forces needle valve element 22 toward a closed position. Because piezoelectric stack 16 is decreasing in length along the longitudinal axis, and because hydraulic link 25 requires some time to respond to the decrease in force from plunger 20, piezoelectric sensor 52 shows a decrease in pressure at region 104 on sensor signal curve 86. As needle 22 moves closer to the internal seat on nozzle housing 9, fuel flow decreases as shown at portion 106 on fueling rate curve 88 and the pressure from the fuel rail on hydraulic link 25 decreases, which decreases the pressure on piezoelectric sensor 52 from hydraulic link 25, as shown at portion 108 on sensor signal curve 86. At point 110 on fueling rate curve 88, fuel flow ceases completely, signaling the end of injection. With the exception of small fluctuations as pressures equalize, the output signal from piezoelectric sensor 52 returns to zero.

When needle 22 is closed against the internal seat formed on nozzle housing 9, pressure within chamber 21 becomes the same as pressure in a fuel rail (not shown) associated with fuel injector 10. As the pressure in the fuel rail varies, the force from the pressure communicates upwardly from hydraulic link 25 in nozzle portion 14 through plunger 20, guide 36, support 38, and sensor platform 34 into piezoelectric sensor 52. Piezoelectric sensor 52 now indicates the condition of the fuel rail and thus may indicate or diagnose performance of the fuel rail during intervals when fuel injector 10 is in a closed or non-fueling state.

Although piezoelectric actuator assembly 12 and sensor assembly 30 are described in an exemplary embodiment herein as used in a particular type of fuel injector, i.e., direct acting with hydraulic intensifier, the assemblies may be used in other types of fuel injectors.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel injector assembly for an internal combustion engine, comprising:

a piezoelectric actuation portion including a piezoelectric stack having a distal end;

a nozzle portion;

a plunger positioned between the nozzle portion and the piezoelectric stack and adapted for movement by said piezoelectric stack;

a piezoelectric sensor positioned between the piezoelectric actuation portion and the plunger, the piezoelectric sensor adapted to generate an output signal; and a rigid body positioned between the distal end of the piezoelectric stack and the piezoelectric sensor to position the piezoelectric sensor a spaced distance from the distal end of the piezoelectric stack, the rigid body including a first surface positioned to support the piezoelectric sensor and a second surface positioned to receive a force from the piezoelectric stack, wherein the rigid body is a carrier for the sensor including a side wall having a lip formed thereon and being adapted to secure the piezoelectric sensor in the carrier.

2. The fuel injector assembly of claim 1, wherein the nozzle portion includes a nozzle housing and a needle valve element positioned in the nozzle housing.

3. The fuel injector assembly of claim 1, wherein the piezoelectric sensor and the rigid body are attached to form a sensor assembly.

4. The fuel injector assembly of claim 1, wherein the piezoelectric sensor provides a positive output signal in response to expansion of the piezoelectric stack.

5. The fuel injector assembly of claim 4, wherein the output signal from the piezoelectric sensor decreases toward zero as a fuel flow from the injection portion initially increases.

6. The fuel injector assembly of claim 5, wherein the output signal from the piezoelectric sensor increases toward zero as the fuel flow from the injection portion falls from a steady state condition toward a shut off condition.

7. The fuel injector assembly of claim 1, wherein the rigid body is fabricated from a metal.

8. The fuel injector assembly of claim 7, wherein the metal is a stainless steel.

9. A fuel injector assembly for an internal combustion engine, comprising:

a piezoelectric actuation portion having an abutting surface;

a nozzle portion;

a plunger positioned between the nozzle portion and the piezoelectric actuation portion and adapted for movement by said piezoelectric actuation portion; and an interface portion positioned between the piezoelectric actuation portion and the plunger and in contact with the piezoelectric actuation portion and the plunger, the interface portion including a piezoelectric sensor and a rigid body adapted to support the piezoelectric sensor, the rigid body adapted to contact the abutting surface and adapted to space the piezoelectric sensor away from the piezoelectric actuation portion, wherein the rigid body includes a side wall having a lip formed thereon to secure the piezoelectric sensor in the rigid body.

10. The fuel injector assembly of claim 9, wherein the nozzle portion includes a nozzle housing and a needle valve element positioned in the nozzle housing.

11. The fuel injector assembly of claim 9, wherein the rigid body is a sensor housing formed of a metal.

12. The fuel injector assembly of claim 11, wherein the metal is a stainless steel.

13. The fuel injector assembly of claim 9, wherein the sensor and the rigid body are attached to form a sensor assembly.

14. A fuel injector assembly for an internal combustion engine, comprising:

a piezoelectric actuation portion having an abutting surface;

a nozzle portion;

a plunger positioned between the nozzle portion and the piezoelectric actuation portion and adapted for movement by said piezoelectric actuation portion;

the nozzle portion operable by movement of the piezoelectric actuation portion to have a start of injection event and an end of injection event;

an interface portion positioned between the piezoelectric actuation portion and the injection portion and in contact with the piezoelectric actuation portion and the injection portion, the interface portion including a piezoelectric sensor adapted to provide a decreasing signal during the start of injection event and an increasing signal during the end of injection event; and a carrier portion formed of a rigid material and adapted to support the piezoelectric sensor, the carrier portion positioned in an abutting relationship to the piezoelectric actuation portion, wherein the carrier portion includes a lip adapted to provide an interference fit with the piezoelectric sensor to maintain the piezoelectric sensor in contact with the carrier portion to form an assembly.

15. The fuel injector assembly of claim 14, wherein the rigid material is a metal.

16. The fuel injector assembly of claim 15, wherein the metal is a stainless steel.

17. The fuel injector assembly of claim 14, wherein the start of injection event is induced by a signal applied to the piezoelectric actuation portion and the end of injection event occurs at a time after removal of the signal applied to the piezoelectric actuation portion.

* * * * *